US010577209B2

(12) United States Patent
Wimmer et al.

(10) Patent No.: US 10,577,209 B2
(45) Date of Patent: Mar. 3, 2020

(54) METHOD AND DEVICE FOR HANDLING FLAT AND/OR FILM MATERIAL WOUND ONTO REELS

(71) Applicant: KRONES Aktiengesellschaft, Neutraubling (DE)

(72) Inventors: Thomas Wimmer, Rosenheim (DE); Herbert Spindler, Niedermoosen (DE); Juergen Werner, Bruckmuehl (DE)

(73) Assignee: Krones Aktiengesellschaft, Neutraubling (DE)

( * ) Notice: Subject to any disclaimer, the term of this patent is extended or adjusted under 35 U.S.C. 154(b) by 310 days.

(21) Appl. No.: 15/514,711

(22) PCT Filed: Oct. 26, 2015

(86) PCT No.: PCT/EP2015/074773
§ 371 (c)(1),
(2) Date: Mar. 27, 2017

(87) PCT Pub. No.: WO2016/066596
PCT Pub. Date: May 6, 2016

(65) Prior Publication Data

US 2017/0247214 A1 Aug. 31, 2017

(30) Foreign Application Priority Data

Oct. 30, 2014 (DE) ..... 10 2014 222 168

(51) Int. Cl.
*B65H 19/12* (2006.01)

(52) U.S. Cl.
CPC ..... *B65H 19/12* (2013.01); *B65H 2220/01* (2013.01); *B65H 2220/02* (2013.01);
(Continued)

(58) Field of Classification Search
CPC .. B65H 19/12; B65H 19/123; B65H 2220/03; B65H 2220/02; B65H 2220/01;
(Continued)

(56) References Cited

U.S. PATENT DOCUMENTS 4,589,811 A * 5/1986 Riccardo ..... B65H 19/123 193/35 R
4,948,060 A * 8/1990 Kurz ..... B65H 19/105 242/552
(Continued)

FOREIGN PATENT DOCUMENTS

CN 101070124 A 11/2007
CN 202542537 11/2012
(Continued)

OTHER PUBLICATIONS

PCT/EP2015/074773—International Preliminary Report on Patentability dated May 2, 2017.
(Continued)

*Primary Examiner* — William A. Rivera
(74) *Attorney, Agent, or Firm* — Simmons Perrine Moyer Bergman PLC

(57) ABSTRACT

The present invention includes a method and an apparatus (1) for handling flat material and/or film material wound onto rolls (5) and that serves as packaging material. Rolls (5), which are at least partially unwound, are alternately removed from at least one installation position (EB1; EB2) of a packaging machine (3), and in each case a new roll (5) of flat material and/or film material is mounted in the particular installation position (EB1; EB2). After each mounting, an externally arranged layer (15) is extracted from the particular new roll (5) near or in the area of its free end and is attached to a section of a material web being guided in the packaging machine (3). The direction of rotation and/or rotation-direction-conforming orientation of
(Continued)

the new roll (5) is determined and/or verified by means of a capture device.

21 Claims, 7 Drawing Sheets

(52) U.S. Cl.
CPC .... *B65H 2220/03* (2013.01); *B65H 2301/325* (2013.01); *B65H 2553/42* (2013.01); *B65H 2801/81* (2013.01)

(58) Field of Classification Search
CPC ..... B65H 2553/42; B65H 2301/325; B65H 2801/81; B65H 41/12
See application file for complete search history.

(56) References Cited

U.S. PATENT DOCUMENTS

| | | | | |
|---|---|---|---|---|
| 5,205,505 | A * | 4/1993 | Focke | B65B 41/12 242/559.3 |
| 5,209,247 | A | 5/1993 | Rittershaus et al. | |
| 5,219,127 | A | 6/1993 | Boldrini et al. | |
| 5,362,191 | A | 11/1994 | Beckmann | |
| 5,593,107 | A | 1/1997 | Focke et al. | |
| 6,604,704 | B2 | 8/2003 | Kiprowski | |
| 6,629,664 | B2 * | 10/2003 | Weijenborg | B65H 19/1868 242/552 |
| 6,767,318 | B2 | 7/2004 | Spatafora et al. | |
| 7,246,768 | B2 | 7/2007 | Fujiwara et al. | |
| 7,832,682 | B2 | 11/2010 | Keller et al. | |
| 7,975,608 | B2 | 7/2011 | Beck et al. | |
| 7,984,603 | B2 * | 7/2011 | Freudenberg | B65H 19/123 242/559 |
| 8,413,407 | B2 | 4/2013 | Barsacchi | |
| 8,905,346 | B2 * | 12/2014 | Repp | B65H 19/126 242/533.2 |
| 9,573,713 | B2 * | 2/2017 | Huber | B65B 21/245 |
| 10,343,865 | B2 * | 7/2019 | Wimmer | B65H 19/12 |
| 2002/0148924 | A1 | 10/2002 | Nobuta et al. | |
| 2007/0029436 | A1 | 2/2007 | Gaines et al. | |
| 2015/0090831 | A1 * | 4/2015 | Huber | B65B 21/245 242/555.3 |
| 2018/0141772 | A1 * | 5/2018 | Prankl | B65H 19/12 |

FOREIGN PATENT DOCUMENTS

| | | |
|---|---|---|
| DE | 102004026312 | 12/2005 |
| DE | 102008039202 | 2/2010 |
| DE | 102010028292 | 11/2011 |
| EP | 0166884 | 1/1986 |
| GB | 1184591 | 3/1970 |
| GB | 2145046 | 7/1987 |
| JP | H06001506 | 1/1994 |
| JP | 2005324909 | 11/2005 |

OTHER PUBLICATIONS

PCT/EP2015/074740—International Preliminary Report on Patentability dated May 2, 2017.
Chinese Patent Application Second Office Action dated May 3, 2018.
DE 10 2014 222 167.6 German Patent Application—German Search Report dated Jun. 12, 2015.
PCT/EP2015/074740 European PCT Application—International Search Report dated Feb. 2, 2016.
DE 10 2014 222 168.4 German Patent Application—German Search Report dated Jun. 23, 2015.
PCT/EP2015/074773 European PCT Application—International Search Report dated Feb. 3, 2016.
Chinese First Office Action dated Sep. 5, 2017—CN100098.
Chinese First Office Action dated Sep. 27, 2017—CN100098.

* cited by examiner

METHOD AND DEVICE FOR HANDLING FLAT AND/OR FILM MATERIAL WOUND ONTO REELS

CLAIM OF PRIORITY

The present application is a national stage application of International application PCT/EP2015/074773, filed Oct. 26, 2015, which in turn claims priority to German Application DE 10 2014 222 168.4, filed Oct. 30, 2014, all of which are incorporated by reference.

FIELD OF THE INVENTION

The present invention relates to a method and an apparatus for handling flat material and/or film material that is wound onto rolls.

BACKGROUND OF THE INVENTION

It is common in practice to have a grouped set of articles, such as beverage containers or the like, held together by shrink film in order to be able to prevent the set from shifting or from coming undone during a transport. Bundles comprising four, six, or more containers, for example, are known from the prior art. Such bundles continue to be one of the most frequent variants of sales units for beverage container or bottles of PET plastic. It is therefore desirable to assemble such bundles as quickly as possible without interruption of individual process steps in order to be able to achieve a high throughput.

Apparatuses and methods are already known that unwind the packaging material or, as the case may be, the shrink film from one or more rolls in order to supply the material to the bundles. Hereupon, the individual bundles or, as the case may be, the particular articles provided for the bundle, are wrapped into the packaging material. The unwinding of the packaging material from the roll can be carried out by machine. Apparatuses are known, which, for example, extract the packaging material from the roll by way of rollers, with the particular roll being meanwhile rotatingly moved. After the supply of packaging material on a roll is depleted, the roll in question has to be exchanged by or replaced with a new roll. This involves an undesirable interruption of the process of assembling the bundles.

A method and an apparatus by which new reels can be supplied and depleted reels can be exchanged are known, for example, from DE 40 40 545 A1. This known apparatus has a plurality of reels arranged side by side for supplying strip material. The core of the reels is in each case positioned on a common pin. A beginning section of the strip material is previously brought into contact with a roller, which extracts the strip material from the particular reel and guides it in a downward direction away from the apparatus. In order to be able to operate the apparatus according to DE 40 40 545 A1 and to unwind the material from the roll, the roll has to be positioned rotation-direction-conformingly with its core on the pin. The strip material or, as the case may be, the first layer of the strip material has to dip coming from above toward the rollers. If the roll were positioned on the pin in counterrotating direction, the strip material could not, or only with difficulty, be extracted from the roll, resulting in complications for unwinding. In apparatuses according to DE 40 40 545 A1, a manual and rotation-conforming positioning is therefore necessary in order to ensure disruption-free operation.

An apparatus is moreover known from DE 10 2004 026 312 A1 with a foil splicing station where the foil web of a new roll that is mounted into a packaging machine is transferred with the support of a holding device to a sealing device. The holding device can, in particular, be formed as a manually operable clamping strip, with the aid of which a foil beginning can be extracted from a new roll and provided to a transfer device, which can supply the foil beginning to a sealing device, by which the foil beginning is heat-sealed to a foil web that is already located in the packaging machine. The clamping strip is described there as an implement that is easy to handle for bringing the foil web into an appropriate position. The clamping strip is loose, however, that is, it is not linked to the machine or to the sealing device.

An at least partly automated method for roll replacement and a corresponding apparatus is known from DE 10 2013 110 944 A1. Here, the new foil rolls to be supplied to a packaging machine are in each case fitted onto differently configured exchangeable carrier units, which can be mounted in the packaging machine alternately in different installation positions. In this context, it is superfluous to supply a free foil end of the new rolls manually, because the exchangeable carrier units are configured in such a manner that the foil sections can be attached to each other in the machine automatically.

One object of the present invention in view of the known prior art is to provide an apparatus and a method for handling flat material and/or film material that is wound onto rolls, by which apparatus and method the susceptibility to disruption of a packaging machine can be reduced. The apparatus according to the invention and the method according to the invention it is moreover intended to facilitate handling of flat material and/or film material.

SUMMARY OF THE INVENTION

The above objects are fulfilled by an apparatus and a method comprising the features in the independent claims. Further advantageous embodiments of the invention are described in the relevant dependent claims.

The invention relates to a method for handling flat material and/or film material that is wound onto rolls and that serves as packaging material for the packaging of piece goods, bundles, or the like sets of articles. The flat material and/or film material can therefore be formed as shrink film. The rolls can have a core in a geometric form corresponding to a hollow cylinder and at least partly consisting of a cellulosic material. Advantageously, each particular new roll can hereby be positioned on a pin of the packaging machine, the pin corresponding with the core, and the roll can rotatingly revolve on the pin when packaging material is being extracted or, as the case may be, is being removed from the roll.

For the purpose of maintaining an approximately continuous or also a discontinuous packaging operation, rolls, which are at least partially unwound and/or depleted, are, in the context of a first option of the method, removed from at least one installation position of a packaging machine, and in each case replaced with new rolls of flat material and/or film material. However, for the purpose of maintaining an approximately continuous packaging operation, the method can also provide that rolls, which are at least partially unwound and/or depleted, are alternately removed from at least two different installation positions of a packaging machine, and that hereupon in each case a new roll of flat material and/or film material is mounted in the particular installation position. As already mentioned above, the at least one installation position or, as the case may be, each of the at least two installation positions can have a pin, on which the new roll is positioned, and on which the particular roll rotates for the purpose of unwinding its particular flat material and/or film material. In particular, the rolls can be clampingly fixed on the pin of their particular installation position. The pin can be rotationally driven and can transmit a torque to the particular roll mounted on it such that the roll is rotatingly moved by way of its pin to unwind its flat material and/or film material. Each pin can be associated with a drive, by way of which the particular pin is rotated. It should be additionally noted that the at least one installation position for the rolls with flat material and/or film material wound thereonto or, as the case may be, the typically two installation positions with their rotatable retaining pin for the rolls of flat material and/or film material can be designed to be height-adjustable, for instance, in order to be able to carry out an adaptation to different roll diameters and/or a correction of the conveying paths with gradually depleting material supply of a roll, which is being unwound and which therefore gradually decreases in diameter.

The drives can be linked to a control unit described in more detail below or, as the case may be, they can be activated to rotate the pins by way of a control unit described in more detail below. Before removing a roll with at least partially unwound and/or depleted packaging material from its particular installation position, the clamping connection between the pin and the roll can be undone such that the roll is no longer fixedly linked to the pin and can be removed from the pin. The rotating movement of the pin can be interrupted until a new roll has been positioned on the pin or, as the case may be, until it has been mounted in the corresponding installation position.

For the purpose of maintaining an approximately continuous packaging operation, rolls, which are at least partially unwound and/or depleted, can in the course of the method be typically alternately removed from at least two different installation positions of the packaging machine, and in each case a new roll of flat material and/or film material can be hereupon mounted in the particular installation position. As already mentioned above, each of the at least two installation positions can have a pin, on which the new roll is positioned, and on which the particular roll rotates for the purpose of unwinding its particular flat material and/or film material. While the rolls are being replaced, the packaging operation can be interrupted or, as the case may be, it can continue uninterrupted. The above-mentioned variant with only one installation position for a roll, however, only enables an uninterrupted packaging operation during roll replacement if an additional storage for flat material and/or film material is provided, out of which this material can be conveyed and supplied to the packaging operation during roll replacement. The method generally enables an interruption-free handling of flat material and/or film material that is wound onto rolls and that serves as packaging material for piece goods, bundles, or the like sets of articles, such that a continuously ongoing packaging operation can be therewith maintained. For this purpose, however, at least two different installation positions for one roll of flat material and/or film material each are required such that the roll, which is located in one installation position, can be continuously unwound, while the respectively other installation position is available for roll replacement and for the supply of new flat material and/or film material, such that—according to the design of the processes of replacing and attaching, of bonding or heat-sealing—a continuous or, as the case may be, a quasi-continuous packaging operation can be maintained during roll replacement. The method according to the invention relates likewise to handling flat material and/or film material wound onto rolls within a packaging process both where such a handling is interruption-free and where it is briefly interrupted. Since the method also relates to a handling method involving the use of only one installation position within the packaging machine, it becomes clear that a continuous or, as the case may be, an uninterrupted packaging operation is only possible with the help of an intermediate storage or another support measure, because the conveying process of film material or, as the case may be, flat material has to be interrupted at least during roll replacement.

After each mounting of a new roll in its particular installation position, an externally arranged layer is extracted from the particular new roll near or in the area of its free end and, for the purpose of forming an uninterrupted material web, is attached to a section of a material web being guided in the packaging machine. The extraction can be effected mechanically, for example by negative pressure and/or by clamping and by way of a fixing rod, which grips the externally arranged layer of the particular new roll and moves the externally arranged layer away from the particular new roll. The fixing rod can be moved relative to the installation position for the roll or also back and forth between the at least two installation positions. Furthermore, a sealing bar can be provided, which is moved downward and in the process heat-seals the externally arranged layer of the particular new roll to the material web being guided in the packaging machine. The externally arranged layer in question can be moved into the operating range of the sealing bar by way of the fixing rod. In interaction with the associated sealing device, the sealing bar can thus move the externally arranged layer of the new roll in question against the material web that is being guided in the packaging machine. Inside the sealing device, the material web sections can be temperature-controlled and in this way heat-sealed. Such embodiments of sealing devices have proved successful in which the sealing bar moves vertically up and down and thereby inserts the material webs into the sealing device and positions them there, where, after a vertical downward movement of the sealing bar, the particular externally arranged layer of a new roll is heat-sealed to a material web that is being guided in the packaging machine.

The direction of rotation and/or the rotation-direction-conforming orientation of the new roll is moreover determined and/or verified by a capture device before, while, or after the new roll is mounted. In practice such embodiments have proved particularly successful, in this context, in which the determination and/or the verification of the direction of rotation and/or of the rotation-direction-conforming orientation is carried out by optical capture. The invention is, however, not limited to suchlike exemplary embodiments so that haptic and/or further mechanisms, for example, can also be provided for verifying the direction of rotation and/or the rotation-direction-conforming orientation of the particular new roll. Sensor detection can optionally also be carried out with the help of tactile detectors or, as the case may be, of a tactile, that is, of a touch detection system, which can be arranged in the area of at least one installation position. The detection system or, as the case may be, the tactile or, as the case may be, the touch detector and the handling device can be linked to a control unit. Furthermore, sensor detection can also be carried out with the help of ultrasonic detectors or, as the case may be, of an ultrasonic detection system, which can be arranged in the area of the installation positions for the rolls with flat material and/or film material wound thereonto. The detection system or, as the case may be, the ultrasonic detector and the handling device can in turn be linked to the mentioned control unit.

If the detected direction of rotation and/or the detected rotation-direction-conforming orientation is appropriate or, as the case may be, if it corresponds to a predetermined target orientation and/or to a target direction of rotation, the particular new roll can be mounted in its associated installation position or, as the case may be, remain in its particular associated installation position. If a wrong direction of rotation and/or a non-rotation-direction-conforming positioning is determined by the capture device, an alignment correction of the particular new roll is performed or a further new roll with appropriate direction of rotation and/or rotation-direction-conforming orientation is selected for mounting and is mounted in the particular installation position.

It is for instance possible that a direction of rotation and/or a rotation-direction-conforming positioning of a new roll that has already been mounted in its particular installation position is verified and/or determined by the capture device. If a wrong direction of rotation and/or a non-rotation-direction-conforming positioning is determined by the capture device, the particular new roll can be removed from the packaging machine, can be oriented or, as the case may be, aligned rotation-direction-conformingly or, as the case may be, with an appropriate direction of rotation, and can subsequently be again mounted in its particular installation position. The rotation-direction-conforming orientation or, as the case may be, the orientation with the appropriate direction of rotation as well as the repeated mounting of the roll in its particular installation position can then be carried out before attaching or, as the case may be, before heat-sealing its externally arranged layer to the material web still remaining in the packaging machine.

It is also conceivable that a direction of rotation and/or a rotation-direction-conforming positioning of a new roll is verified and/or determined before it is mounted in its particular installation position. If a wrong direction of rotation and/or a non-rotation-direction-conforming positioning is then determined or, as the case may be, verified by the capture device, there is the possibility of verifying or, as the case may be, of determining the direction of rotation and/or the rotation-direction-conforming positioning of a further roll and of mounting this roll in the installation position if it has the appropriate direction of rotation and/or rotation-direction-conforming positioning. Alternatively, the new roll can be brought into an appropriate rotation-direction-conforming orientation or, as the case may be, into an appropriate direction of rotation and can then be mounted in the particular installation position.

Alternatively, however, an additional pulley can also be used, which makes it possible to leave rolls in place that would normally have to be turned around, and to guide the flat material and/or film material being unwound from these rolls over this optionally applicable pulley in order to adapt the flat web guidance to the required processing direction in the packaging machine. If the roll with the flat material and/or film material wound onto it has been mounted with the appropriate direction of rotation, however, this additional pulley is not required so that it can be shifted or deactivated or also removed from its place by machine, as the case may be.

In particularly preferred embodiments of the present invention, the at least partially unwound and/or depleted rolls can be autonomously removed by a handling device, which is in operative connection with the capture device, and new rolls of flat material and/or film material can be mounted in the provided installation position or, as the case may be, in the optionally available two or more installation positions. Receiving of a new roll with rotation-direction-conforming orientation or, as the case may be, with an appropriate direction of rotation by way of the handling device as well as subsequent mounting in the particular installation position of the roll and/or optional activating of the mentioned additional pulley for correcting the direction of rotation of a newly mounted roll can thus be carried out fully automatically. The handling device can be coupled to the capture device by way of a control unit, for example.

If the packaging machine is equipped with more than one installation position for rolls, it can optionally be provided that the rolls are rotatingly moved with the same direction of rotation in all of the at least two installation positions for the purpose of unwinding the packaging material. Based on the web guiding, the rolls can also rotate in different directions of rotation. Depending on the embodiment of the apparatus according to the invention, the material webs can be extracted from the rolls from above or from below, thereby determining the rotational directions of the rolls.

It is also conceivable that in each case at least one marker, particularly an optical marker, and more particularly at least one reflective marking, is applied onto a section of the new rolls in the area of their free ends, by which marker the capture device determines and/or verifies the direction of rotation and/or the rotation-direction-conforming orientation of the new roll. The optical marker can be formed as an adhesive label and it can be glued or, as the case may be, attached by surface adhesion onto the section of the new rolls in the area of their free ends. In particular, at least two optical markers or, as the case may be, at least two reflective markings can be provided for each free end of a new roll. If other than optical capture systems are applied, it can be useful to arrange suchlike detectable markers on the rolls, for example such markers as can be detected by ultrasonic capture devices or by tactile capture devices.

It is furthermore possible that the at least one marker or, as the case may be, the at least one optical marker is applied onto the particular new roll before it is mounted in its particular installation position such that the free end of the particular new roll is at least largely immovably fastened to the particular new roll by the marker. Since the free end is hereby immovably fastened to the particular new roll, its externally arranged layer can simply be extracted near or in the area of its free end after that particular new roll has been mounted. As already mentioned, the extraction can be carried out by a fixing rod, for example, which preferably mechanically fixes or, as the case may be, grips the externally arranged layer of the new roll in the area of its free end and hereupon moves away from the new roll in order to extract the externally arranged layer from the new roll. Pneumatically operating gripper bars or suction bars have proved to be a particularly suitable variant of the fixing rod, which bars have a multitude of suction points or, as the case may be, holes or grooves, to which a variably or fixedly adjusted negative pressure is applied such that they can reliably seize and grip the material webs; and moreover, such pneumatically operating suction grippers are also able to extract the material webs from the rolls, as the case may be, supported by a motor drive of the particular roller bearing, which serves for a corresponding unrolling movement of the rolls while the suction gripper or the fixing rod extracts the material web.

The optical capture device can moreover have an optical detector, which is moved into the area of the particular new roll by way of the handling device and there detects the particular optical marker of the new roll for the purpose of verifying and/or determining the direction of rotation and/or the rotation-direction-conforming positioning of the new roll. In particular, the optical detector can be formed as a camera system, which is linked to a control unit. If other sensor systems or, as the case may be, other sensor concepts are used, the detector used in each case can be moved into the area of the particular new roll by way of the handling device and can there detect the particular capturable marker of the new roll for the purpose of verifying and/or determining the direction of rotation and/or the rotation-direction-conforming positioning of the new roll. In particular, the detector can be formed as an ultrasonic capture system or as a tactile capture system, which is linked to a control unit.

There are moreover conceivable embodiments in which the handling device has a retaining mandrel, which dips into the face side of the new roll, which is designed as hollow body, hereupon increases its maximum cross-sectional diameter and hereby clampingly fixes the particular new roll to the handling device. The detection system, which operates optically or, as the case may be, in a different manner, can be arranged in the area of the retaining mandrel such that first a verification or, as the case may be, a determination of the direction of rotation and/or of the rotation-direction-conforming positioning of a particular new roll can be carried out and subsequently, in prompt consecutive steps, the particular new roll, in the instance of an appropriate direction of rotation and/or rotation-direction-conforming positioning, is picked up by the retaining mandrel of the handling device by way of increasing the mandrel's maximum cross-sectional diameter.

The longitudinal extension of the retaining mandrel can be formed to be less in comparison to the longitudinal extension of the hollow core of the new rolls such that the particular new roll can be slid onto one of the pins associated with the particular installation position of the packaging machine with the retaining mandrel engaging into the core. The cross-sectional diameter of the retaining mandrel can hereafter be decreased such that the clamping connection between the retaining mandrel and the particular new roll comes undone. The handling device or, as the case may be, the retaining mandrel of the handling device, can then be guided toward a further new roll while the new roll that has been mounted in the particular installation position by way of the handling device is non-rotatingly positioned on the associated pin. For the purpose of producing the non-rotating connection between the pin and the particular roll positioned on the pin, it is also possible to increase the cross-sectional diameter of the pin.

Furthermore, the new rolls can be mounted in their particular installation position in such a manner that after being mounted their free ends are oriented toward an oppositely located installation position of the at least two installation positions. For this purpose it can be provided, for instance, that the at least one optical marker, which has been applied onto a section of the new rolls in the area of their free ends, is detected by the optical detector or, as the case may be, by the optical detection system, an according information is transmitted to a control unit, and the control unit activates the handling device such that, after the new rolls have been mounted, the free ends are oriented toward an in each case oppositely located installation position of the at least two installation positions. The same generally holds true for other measuring principles not operating with optical capture, for example for tactile capture variants or for ultrasonic measurements or the like.

In further embodiments it is conceivable that the detector or, as the case may be, the optical detector or, as the case may be, the detection system operating optically or in a different manner is arranged in the area of the at least two installation positions and, after a particular new roll has been mounted, it detects an orientation of the at least one marker (for example of the optical marker or of the tactilely capturable marker or of the marker that is capturable by ultrasound) and transmits the according information to the control unit. The control unit can further cause a rotation of the pin, on which the new rolls are positioned, such that the free ends or, as the case may be, the optical markers of the new rolls face toward the in each case oppositely located installation position of the at least two installation positions.

It is moreover possible that the new rolls are moved into the area of the handling device and are supplied to the handling device by way of a horizontal conveying device. The horizontal conveying device can be formed as a circulating, endless conveyor belt. A manipulator can be positioned at the beginning or on the side of a conveyor line section of the horizontal conveying device, by which manipulator new rolls can be positioned preferably standing upright onto the horizontal conveying device. As the case may be, the handling device can take new rolls directly from the horizontal conveying device and can mount them in the packaging machine or, as the case may be, in the at least two installation positions of the packaging machine. The manipulator can also have a retaining mandrel, which is inserted into new rolls on their face side or, as the case may be, into a core of the new rolls, and which grips the new rolls by way of increasing its cross-sectional diameter. It can be provided, in particular, that the manipulator is manually operable and that a positioning of new rolls is carried out by the manipulator by a user.

The invention moreover relates to an apparatus for handling flat material and/or film material that is wound onto rolls and that serves as packaging material for the packaging of piece goods, bundles, or the like sets of articles. It should be noted here that various features pointed out above in the context of embodiments of the method according to the invention can likewise be provided for conceivable embodiments of the apparatus according to the invention. Furthermore, features pointed out below in the context of conceivable embodiments of the apparatus according to the invention can be provided for various embodiments of the method according to the invention.

The apparatus comprises a packaging machine with at least one installation position, which is provided for the rotating reception of rolls of flat material and/or film material. The apparatus can optionally, however, also comprise a packaging machine with at least two different installation positions, each of which are provided for the rotating reception of rolls of flat material and/or film material. A further part of the packaging machine are one or more coupling device, which are formed for aligning and attaching free end sections of flat material and/or film material of the new rolls mounted in the installation position or, as the case may be, of the new rolls mounted in the at least two installation positions, each to a material web, which is already being guided in the packaging machine. The material web, which is already being guided in the packaging machine, can be extracted from a roll, which is already arranged in the packaging machine in its particular installation position at the time of mounting the new roll. It is thus possible to continuously unwind flat material and/or film material from at least one roll located in the packaging machine or, as the case may be, from at least one roll of the at least two installation positions, thus making it possible to ensure a continuous packaging operation. It should be emphasized here, however, that the interruption-free or, as the case may be, the continuous packaging operation by way of using two or more installation positions for two or more rolls represents a special case of the packaging machine, while the apparatus according to the invention likewise relates to the case of the packaging operation that is briefly interrupted for roll replacement, where the packaging operation is equipped with only one installation position for an individual roll of flat material and/or film material for packaging purposes.

As part of the one or more coupling device there can be a sealing bar, for example, as well as a fixing rod, and since these have already been described above, their function and their design are not mentioned again below.

The apparatus according to the invention moreover has at least one capture device, which is preferably designed for verifying and/or determining by an optical detection system or, as the case may be, by an optical detector a direction of rotation and/or rotation-direction-conforming orientation of particular new rolls provided for the at least two installation positions. The optical detection system or, as the case may be, the optical detector can comprise at least one camera system. Optionally, however, the apparatus according to the invention can also be equipped with capture devices for other manners of sensor detection. Sensor detection can thus optionally also be carried out with the help of tactile detectors or, as the case may be, of a tactile, that is, of a touch detection system, which can be arranged in the area of the at least one installation position. The detection system or, as the case may be, the tactile or, as the case may be, the touch detector and the handling device can be linked to a control unit. Furthermore, sensor detection can also be carried out with the help of ultrasonic detectors or, as the case may be, of an ultrasonic detection system, which can be arranged in the area of the installation positions for the rolls with flat material and/or film material wound thereonto. The detection system or, as the case may be, the ultrasonic detector and the handling device can in turn be linked to the mentioned control unit.

The apparatus furthermore has a control unit coupled with the capture device, by which control unit information on the direction of rotation and/or on the rotation-direction-conforming orientation is outputable and/or by which a mounting of new rolls with an appropriate direction of rotation and/or an appropriate rotation-direction-conforming orientation for the installation position is initiatable.

It is conceivable, for instance, that the apparatus has an optical display unit coupled with the control unit, such as for example a display or the like, by way of which information on the direction of rotation and/or on the rotation-direction-conforming orientation can be shown. It is possible, for example, that a note for a user is output via the optical display unit when the new rolls have a wrong direction of rotation or, as the case may be, a non-rotation-direction-conforming orientation. It is also conceivable that information on the direction of rotation and/or on the rotation-direction-conforming orientation is output as an acoustic signal.

In the instance of new rolls with the appropriate direction of rotation and/or rotation-direction-conforming orientation, initialization can be carried out under operative connection of the control unit with a handling device, or the handling device can be activated to mount a particular new roll with the appropriate direction of rotation and/or rotation-direction-conforming orientation, as the case may be. If an appropriate direction of rotation or, as the case may be, rotation-direction-conforming orientation is determined and/or verified, it can be provided, for example, that the handling device picks up the particular new roll and moves it toward one of the at least two installation positions.

In particular, it is possible that the control unit is linked to a handling device, by which rolls with at least partially unwound and/or depleted flat material and/or film material are autonomously removable from the particular installation position and new rolls with appropriate direction of rotation and/or appropriate rotation-direction-conforming orientation are autonomously mountable in the at least two installation positions. In this context, an algorithm can be stored in the control unit such that a specific activation of the handling device is effected by way of the algorithm in consideration of the direction of rotation and/or of the rotation-direction-conforming orientation of the particular new roll as determined by the capture device.

Instead of removing non-rotation-direction-conformingly mounted new rolls as required, an additional pulley can optionally also be used, which makes it possible to leave rolls in place that would normally have to be turned around, and to guide the flat material and/or film material being unwound from these rolls over this optionally applicable pulley in order to adapt the flat web guidance to the required processing direction in the packaging machine. If the roll with the flat material and/or film material wound onto it has been mounted in the appropriate direction of rotation, however, this additional pulley is not required so that it can be shifted or deactivated or also removed from its place by machine, as the case may be.

Moreover, the handling device can comprise a preferably cylindrically formed retaining mandrel with an adjustable maximum cross-sectional diameter for the purpose of the clamping fixation of the new rolls, which are formed as hollow bodies. The adjustment of the cross-sectional diameter can be carried out by way of the control unit or, as the case may be, can be specified by the control unit. The handling device can have a movable gripping arm with the retaining mandrel being arranged at the free end of the gripping arm.

In particularly preferred embodiments it is possible that a horizontal conveying device that is designed for the transport of new rolls is arranged upstream of the handling device, which horizontal conveying device extends into an operating range of the handling device. It is conceivable that in further embodiments new rolls are supplied to the handling device on pallets or the like. It is also possible to place new rolls in a container or the like, which is located in the operating range of the handling device, and by way of which new rolls are supplied to the handling device. The new rolls can be placed into the container unsorted or, as the case may be, in random orientation, with the direction of rotation and/or the rotation-direction-conforming orientation being verifiable and/or determinable by the capture device.

The capture device can also have an optical detector or, as the case may be, an optical detection system, which is in a mechanically coupled connection to the handling device and is movable by way of the handling device toward the particular new rolls provided for the at least two installation positions. The optical detector or, as the case may be, the optical detection system can here be arranged in the area of a free end of a gripping arm of the handling device. Furthermore, the already described retaining mandrel can be arranged in the area of a free end of a gripping arm of the handling device. The optical detection system or, as the case may be, the optical detector and the retaining mandrel can thus be moved together through the handling device to the particular new roll. In conceivable embodiments of the apparatus according to the invention, the optical detector or, as the case may be, the optical detection system can also be designed as a camera system.

The capture device can moreover have at least one stationary detection system or, as the case may be, at least one stationary detector in the area of the at least two installation positions, with the direction of rotation and/or the rotation-direction-conforming orientation of the particular new rolls mounted in the at least two installation positions being determinable and/or verifiable by way of the detection system or, as the case may be, by way of the stationary detector. The stationary detection system or, as the case may be, the stationary detector can also be designed as a camera system. In this context it is conceivable that the apparatus has at least one stationary detection system or, as the case may be, one stationary detector in the area of the at least two installation positions and also has a detector that is mechanically coupled to the handling device or, as the case may be, a detection system that is coupled to the handling device. In further embodiments, the apparatus can have merely a stationary detection system or, as the case may be, a stationary detector, or a detection system that is mechanically coupled to the handling device or, as the case may be, a detector that is mechanically coupled to the handling device.

BRIEF DESCRIPTION OF THE FIGURES

In the following passages, the attached figures further illustrate exemplary embodiments of the invention and their advantages. The size ratios of the individual elements in the figures do not necessarily reflect the real size ratios. It is to be understood that in some instances various aspects of the invention may be shown exaggerated or enlarged in relation to other elements to facilitate an understanding of the invention.

FIG. 1 moreover illustrates a conceivable implementation of an embodiment for the method according to the invention;

FIG. 2 moreover illustrates a further conceivable implementation of an embodiment for the method according to the invention;

DETAILED DESCRIPTION OF THE INVENTION

Figure 1:
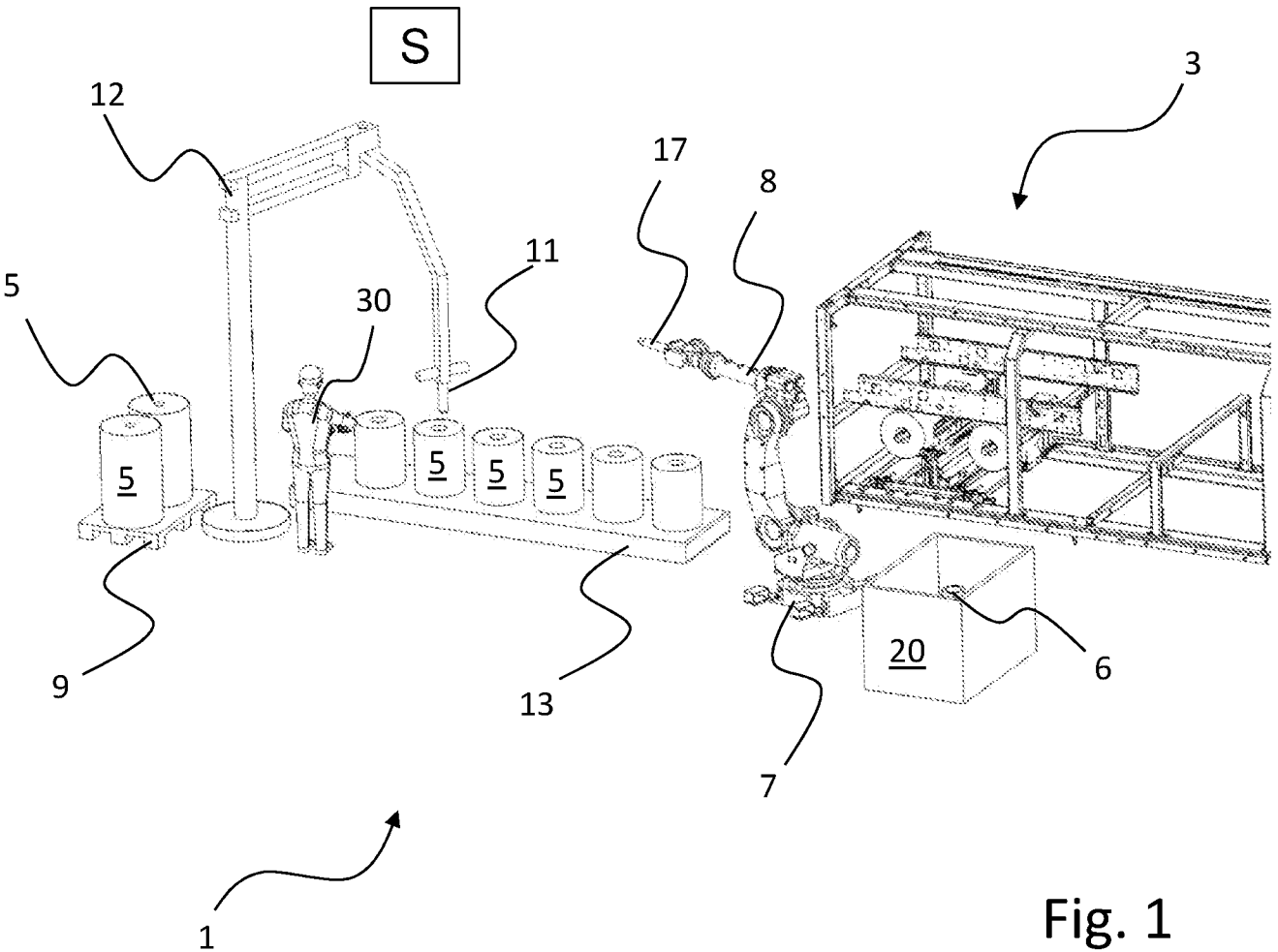
FIG. 1 shows a schematic perspective view of a first embodiment of an apparatus according to the invention.

The same or equivalent elements of the invention are designated by identical reference characters. Furthermore and for the sake of clarity, only the reference characters relevant for describing the respective figure are provided. It should be understood that the detailed description and specific examples of the embodiments of the apparatus or of the method according to the invention are intended for purposes of illustration only and are not intended to limit the scope of the invention.

The schematic perspective view in FIG. 1 shows a first embodiment variant of an apparatus 1 according to the invention for handling flat material and/or film material that is wound onto rolls. FIG. 1 moreover illustrates a possible implementation of an embodiment for the method according to the invention.

The apparatus 1 serves for handling packaging material or, as the case may be, shrink film that is wound onto rolls 5. A packaging machine 3 being supplied new rolls 5 by way of a handling device 7 are discernible in FIG. 1. The handling device 7 mounts the particular new rolls 5 in two different installation positions EB1 and EB2, which are only rudimentarily discernible in FIG. 1 and are exemplarily illustrated in the detailed view of FIG. 3.

Figure 3:
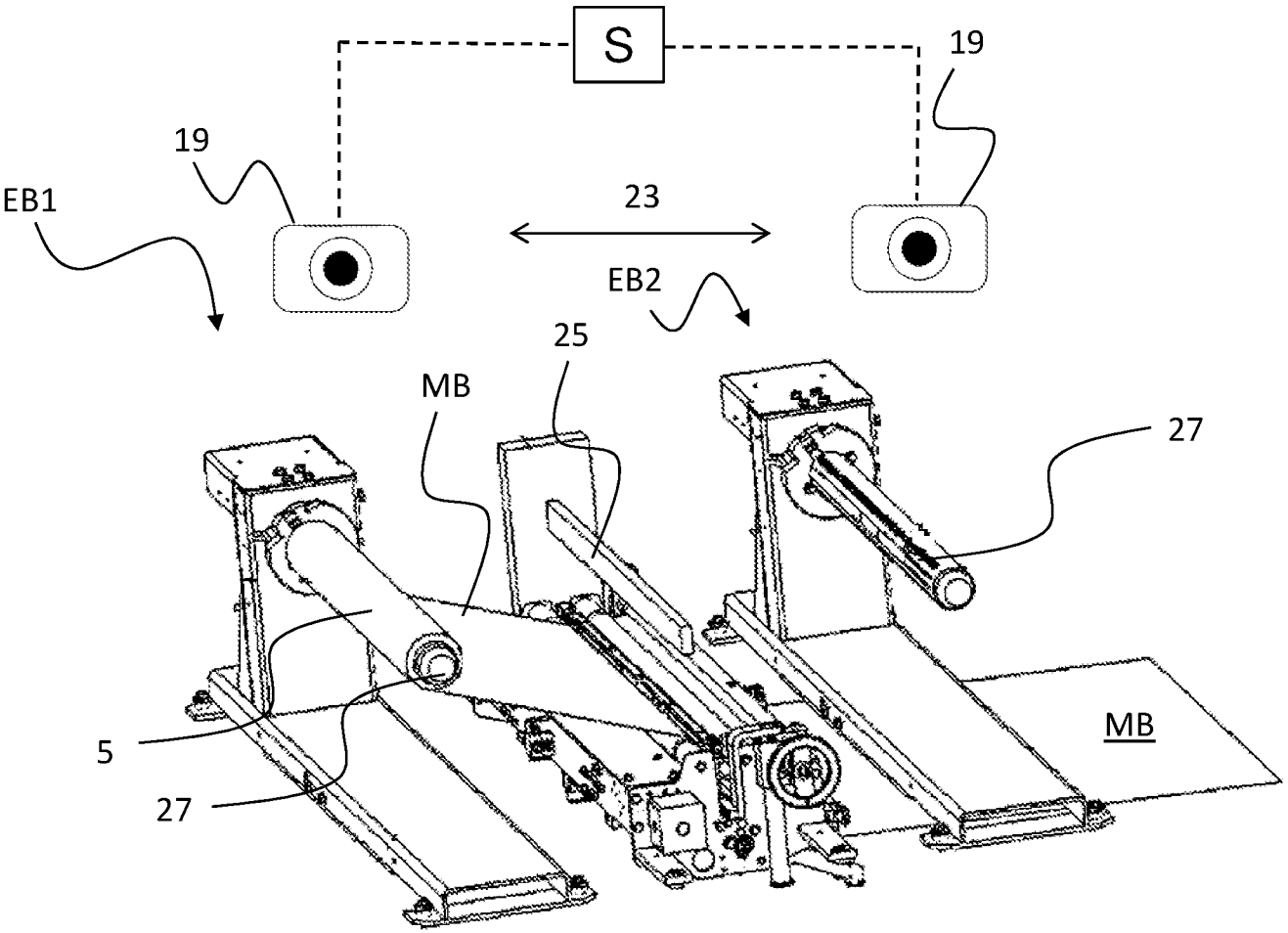
FIG. 3 shows a schematic perspective view of two installation positions as can be provided for an apparatus according to the exemplary embodiments from FIGS. 1 and 2.
Figure 4:
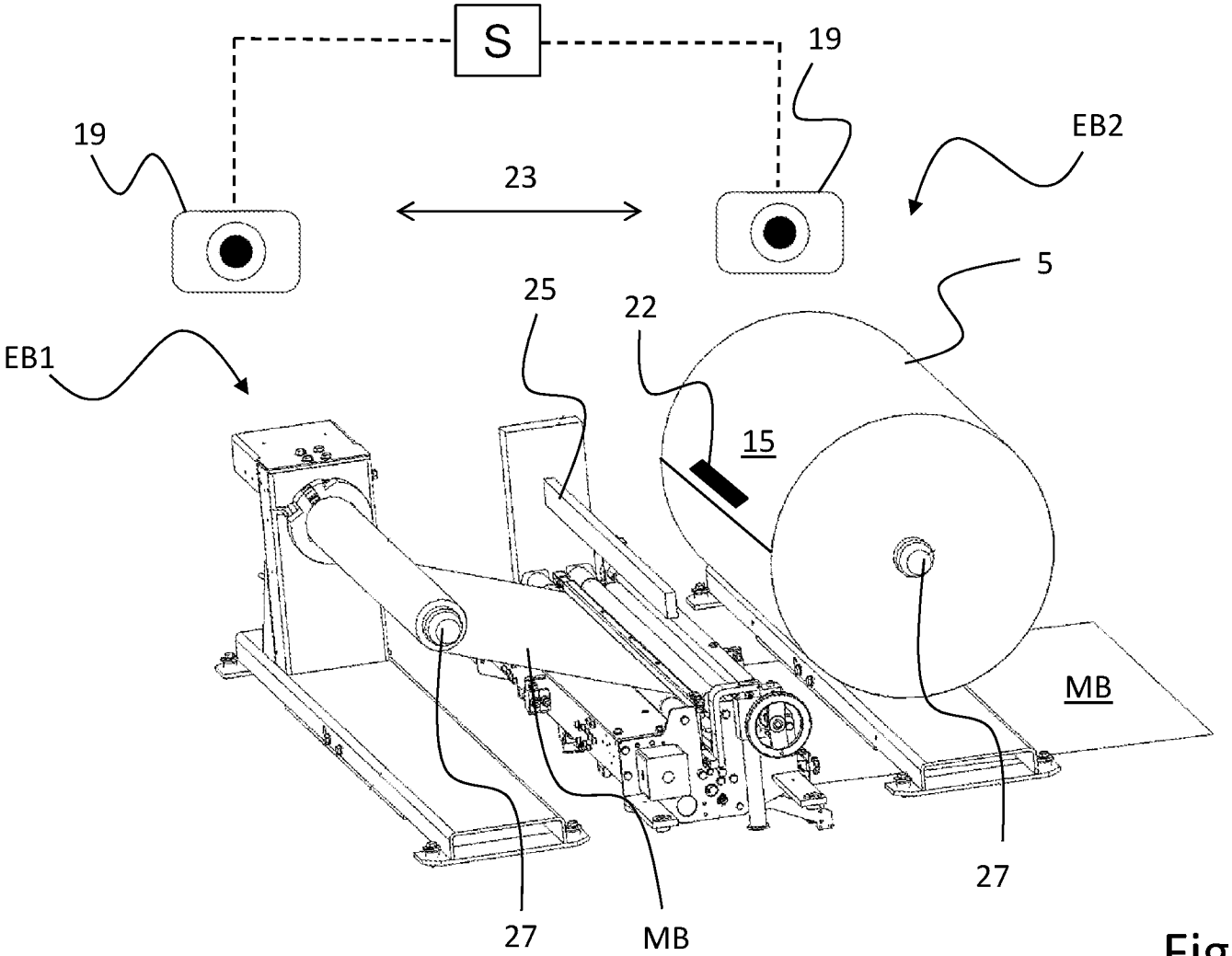
FIG. 4 shows the installation positions of FIG. 3 with a mounted new roll for the second installation position.
Figure 5:
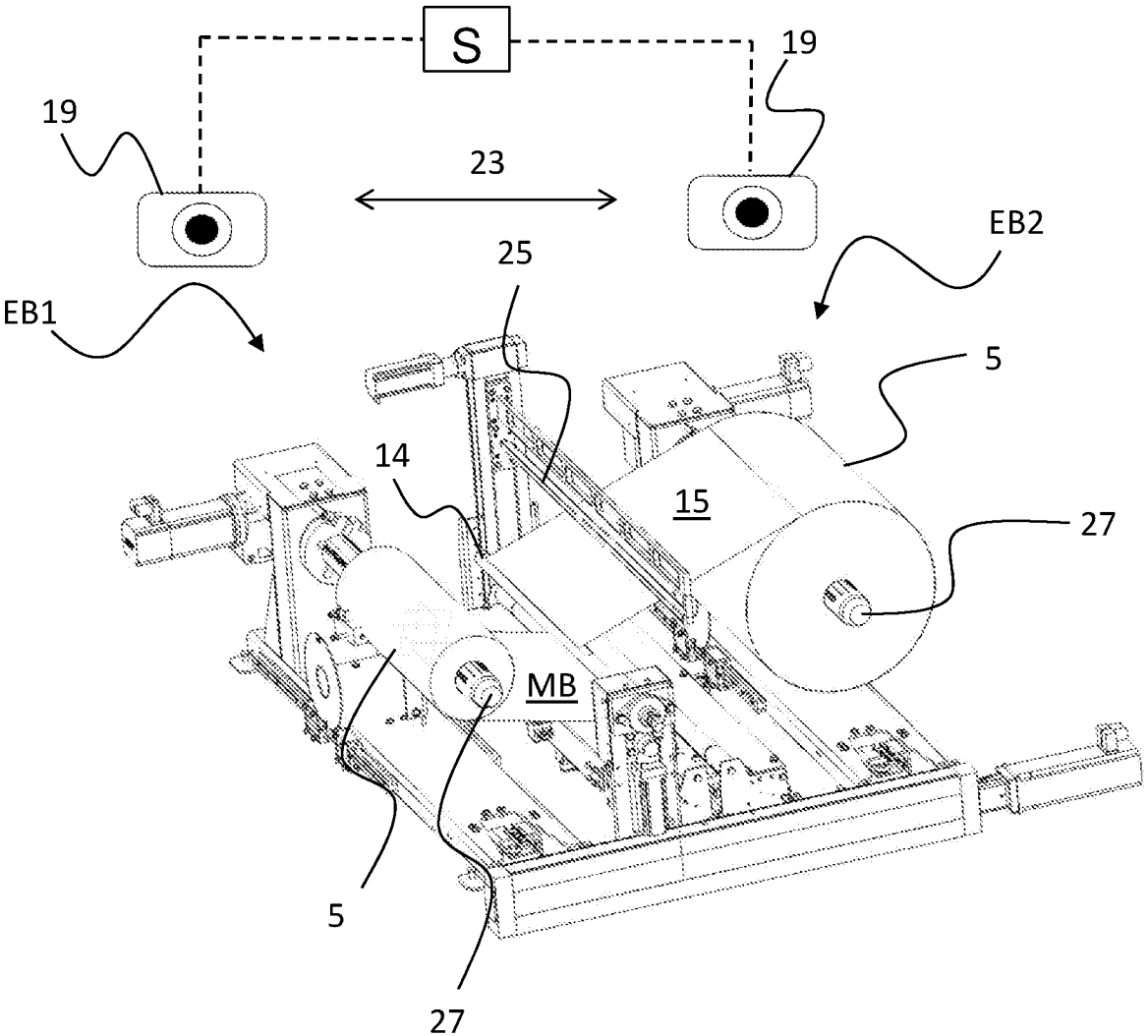
FIG. 5 shows the installation positions of FIGS. 3 and 4 with extracted outer layer of the new roll mounted in the second installation position.

As shown in a synopsis of FIGS. 3 to 5 with FIG. 1, a new roll 5 is mounted in one of the two installation positions EB1 or EB2, as the case may be, by way of the handling device 7, while a roll 5 is still located in the other installation position EB1 or EB2, as the case may be, from where a material web MB is unwound during the mounting of the new roll 5. While the material web MB continues to be unwound from the nearly depleted roll 5, the outer layer 15 (cf. FIG. 5) of the new roll 5 is heat-sealed to the material web MB such that the apparatus 1 can hereby be continuously operated without the necessity of interrupting the process for replacing a depleted roll 5.

The new rolls 5 are composed of packaging material or, as the case may be, of shrink film, as well as of a core 6, onto which the packaging material or, as the case may be, the shrink film is wound. For taking a new roll 5 from the horizontal conveying device 13, the handling device 7 dips into a core 6 on the face side of the new roll by way of a retaining mandrel 17. For this purpose, a gripping arm 8 of the handling device 7 can be rotatingly moved about an axis of rotation 16 as is exemplarily shown in FIG. 6 of the present description of the invention. After the retaining mandrel 17 dips into the core 6, the cross-sectional diameter of the retaining mandrel 17 is increased such that the new roll 5 is clampingly fixed to the retaining mandrel 17, as is also shown in FIG. 7. The core 6 is formed as a hollow cylinder, with the form of the retaining mandrel 17 corresponding hereto such that the retaining mandrel 17 is linked by way of its outer circumference to an inner cover surface of the core 6 for the purpose of clampingly fixing the new roll 5.

New rolls 5 are supplied to the handling device 7 by way of the horizontal conveying device 13 such that another new roll 5 is moved further toward the handling device 7 or, as the case may be, moves up toward the handling device 7 when a new roll 5 is removed from the horizontal conveying device 13. The horizontal conveying device 13 can thus be operated in a clocked manner or continuously at a constant speed. The operation is specified by the control unit S.

Also discernible is a manipulator 12 positioned in the area of the horizontal conveying device 13, which manipulator 12 is operated by a user 30, and by which manipulator 12 new rolls 5 are placed standing upright onto the horizontal conveying device 13. In this context it is conceivable that the user 30 places the new rolls 5 on the horizontal conveying device 13 already in a certain direction of rotation or, as the case may be, in an orientation conforming with a certain direction of rotation, with a later verification or, as the case may be, determination of the appropriate direction of rotation and/or the rotation-direction-conforming orientation of new rolls 5 serving for preventing disruptions of the packaging machine 3 caused by mounting with a wrong direction of rotation or, as the case may be, with a non-rotation-direction-conforming orientation. In further embodiments it is moreover conceivable that the new rolls 5 are placed on the horizontal conveying device 13 by the user 30 in a random direction of rotation or, as the case may be, rotation-direction-conforming orientation, and that the handling device 7 selects new rolls 5 with appropriate direction of rotation or, as the case may be, rotation-direction-conforming orientation and mounts them in the particular installation position EB1 or EB2, as the case may be, of the packaging machine 3. The new rolls 5 stand on a pallet 9, from which the user 30 takes them by the manipulator 12 and places them onto the horizontal conveying device 13. An operating range of the manipulator 12 therefore extends across the pallet 9 as well as across a conveyor line section of the horizontal conveying device 13.

Further illustrated is a container 20, which is located in the operating range of the handling device 7. When the supply of packaging material or, as the case may be, of shrink film of one of the rolls 5 placed in the packaging machine 3 is depleted, the cellulose or plastic core 6 of an empty roll 5 is removed from the packaging machine 3 and deposited in the container 20 by the handling device 7. Only after removing the core 6 can a new roll 5 be mounted in the particular installation position EB1 or EB2, as the case may be, of the packaging machine 3 such that the handling device 7 first removes the core 6 and in temporal succession mounts a new roll 5 in the particular installation position EB1 or EB2, as the case may be.

The horizontal conveying device 13, the handling device 7, and the packaging machine 3 are linked to a control unit S. In the present instance, the control unit S controls the clocked operation of the horizontal conveying device 13, initiates rolls 5 to be mounted in and removed from the two installation positions EB1 and EB2 by the handling device 7, and controls an unwinding of packaging material or, as the case may be, of shrink film from the rolls 5 mounted in the packaging machine 3, as is described in more detail below.

The control unit S has a display or is moreover linked to a display, which is not illustrated here, by way of which information on the direction of rotation or, as the case may be, on the rotation-direction-conforming orientation of new rolls 5 are output in a manner visible to a user 30. As described below for the FIGS. 3 to 7, the direction of rotation or, as the case may be, the rotation-direction-conforming orientation of the new rolls 5 is determined and/or verified by a capture device 23, which is linked to the control unit S. Since the handling device 7 can remove the particular core 6 of an empty roll 5 from the packaging machine 3, and, supported by the capture device 23, autonomously mounts new rolls 5 in the packaging machine 3 with appropriate direction of rotation or, as the case may be, rotation-direction-conforming orientation, the apparatus 1 can be operated completely automated at least from the point of taking new rolls 5 from the horizontal conveying device 13.

Figure 2:
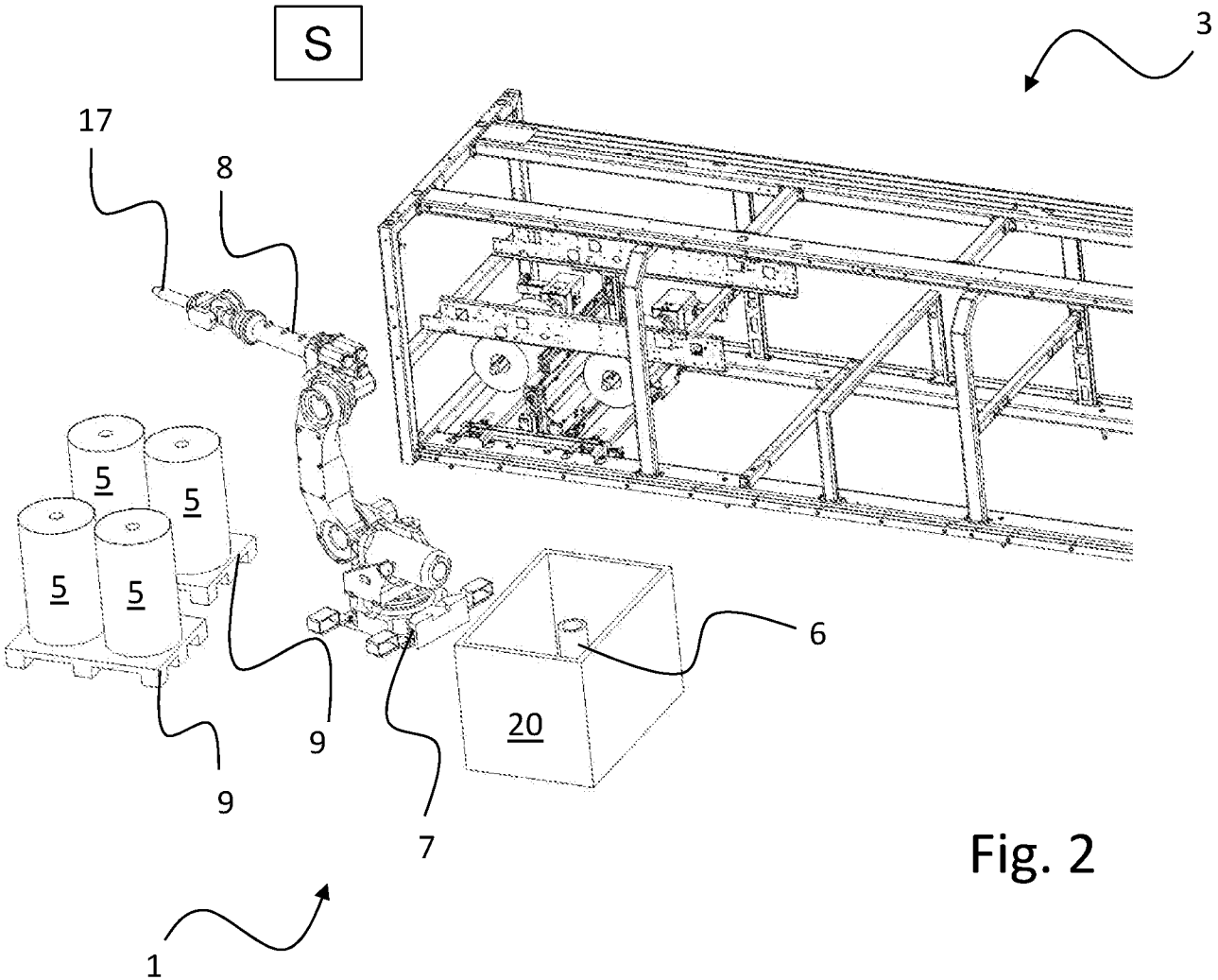
FIG. 2 shows a schematic perspective view of a further embodiment of an apparatus according to the invention.

The schematic perspective view in FIG. 2 shows a further embodiment of the apparatus 1 according to the invention. FIG. 2 moreover illustrates a further conceivable implementation of an embodiment for the method according to the invention.

In comparison to the exemplary embodiment of apparatus 1 in FIG. 1, there is no manipulator 12 as well as no horizontal conveying device 13 provided in the exemplary embodiment according to FIG. 2. The handling device 7, as well as the packaging machine 3, is of the identical construction as in the exemplary embodiment in FIG. 1. Furthermore, a control unit S is present, which is linked to the handling device 7 and to the packaging machine 3.

In FIG. 2, the handling device 7 takes new rolls 5 directly from a pallet 9 and mounts these in the particular installation position EB1 or EB2, as the case may be (cf. FIGS. 3 to 5) of the packaging machine 3, provided they have an appropriate direction of rotation or, as the case may be, rotation-direction-conforming orientation. It is also conceivable here that the direction of rotation or, as the case may be, the rotation-direction-conforming orientation of the new rolls 5 is already present on the pallet 9 and that the capture device 23 (cf. FIGS. 3 to 7) merely verifies the direction of rotation or, as the case may be, the rotation-direction-conforming orientation of the rolls in order to prevent disruption of the packaging machine 3 due to new rolls 5 being mounted with a wrong direction of rotation or, as the case may be, with a non-rotation-direction-conforming orientation. It is also possible that new rolls 5 stand on the pallet 9 in a random direction of rotation or, as the case may be, in an orientation conforming with a random direction of rotation, where the handling device 7, by way of the capture device 23, detects new rolls 5 with appropriate direction of rotation or, as the case may be, rotation-direction-conforming orientation and mounts them in the particular installation position EB1 or, as the case may be, EB2 of the packaging machine 3. The pallets 9 with new rolls 5 can be supplied or, as the case may be, placed in the operating range of the handling device 7 by a user 30 (cf. FIG. 1).

In FIG. 2, the direct take-up of new rolls 5 from the particular pallet 9 is also carried out by the retaining mandrel 17 engaging into the hollow cylindrical core 6 of the new roll 5. The particular core 6 of depleted rolls 5 is likewise placed into a container 20.

The schematic perspective view of FIG. 3 illustrates two installation positions EB1 and EB2 as can be provided for an apparatus 1 or, as the case may be, for a packaging machine 3 according to the exemplary embodiments from FIGS. 1 and 2. Each of the installation positions EB1 and EB2 has an own pin 27, onto which pins 27 new rolls 5 are mounted by way of the handling device 7 (cf. FIGS. 1 and 2) and clampingly fixed to the particular pin 27 by increasing the diameter of the pins 27.

Also illustrated is a sealing bar 25, which is provided for attaching an outer layer 15 (cf. FIG. 5) of the new roll 5 mounted in the particular installation position EB1 or EB2, as the case may be (cf. FIG. 4), to the material web MB remaining in the packaging machine 3, and which is vertically lowered for this purpose. After attaching the outer layer 15 to the material web MB remaining in the packaging machine 3, the sealing bar 25 is vertically lifted and brought into the position illustrated in FIG. 3.

In FIG. 3, a roll 5 is positioned in the first installation position EB1 on the pin 27 of the first installation position EB1 and is rotatingly moved by the pin 27. In the process, the packaging material or, as the case may be, the shrink film of the roll 5 positioned on the pin 27 of the first installation position EB1 is unwound. In the second installation position EB2, a roll 5 has already been completely unwound and the core 6 has been removed by way of the handling device 7 such that the second installation position EB2 or, as the case may be, the pin 27 of the second installation position EB2 is ready for receiving a new roll 5 with packaging material.

FIG. 3 also shows a capture device 23, which in the present example is composed of two cameras 19. In this way, the first installation position EB1 and the second installation position EB2 each have an own camera 19 associated with them. The exemplary embodiment according to FIG. 3 is intended to be understood merely as an example, such that further embodiments are conceivable, in which there is only one camera 19 associated with the two installation positions EB1 and EB2, where the detection range of the camera 19 extends across the two installation positions EB1 and EB2.

The capture device 23 or, as the case may be, the two cameras 19 are linked to a control unit S and serve for determining and/or verifying a particular direction of rotation and/or a particular rotation-direction-conforming orientation of new rolls 5.

The schematic perspective view in FIG. 4 shows the installation positions EB1 and EB2 of FIG. 3 with the mounted new roll 5 for the second installation position EB2. Based on FIG. 3, FIG. 4 shows a new roll 5 that has been slid onto the pin 27 of the second installation position EB2 by the handling device 7 (cf. FIGS. 1 and 2). Packaging material or, as the case may be, shrink film continues to be unwound from the roll 5 of the first installation position EB1 such that the packaging machine 3 (cf. FIGS. 1 and 2) can continue to be operated even while the roll 5 in the second installation position EB2 is being replaced. If a new roll 5 is mounted in the first installation position EB1, packaging material or, as the case may be, shrink film can continue to be unwound from the roll 5 in the second installation position EB2, thus enabling continuous and interruption-free operation of the packaging machine 3.

The new roll 5 of the second installation position EB2 from FIG. 4 has a reflective adhesive label 22, which is applied to the outer layer 15 of the new roll 5 in the area of its free end. The capture device 23 or, as the case may be, the camera 19 associated with the second installation position EB2 is now able to verify by the adhesive label 22 whether the new roll 5 has been slid onto the pin 27 with the appropriate direction of rotation or, as the case may be, with rotation-direction-conforming orientation. A synopsis of the FIGS. 4 and 5 illustrates that for the new roll 5 of the second installation position EB2 the outer layer 15 is guided from above over the roll 5 and dips downward. If the roll 5 had been positioned on the pin 27 of the second installation position EB2 with a wrong direction of rotation or, as the case may be, with a non-rotation-direction-conforming orientation, the outer layer 15 would face downward away from the roll 5 and could therefore not be gripped or could only be gripped with difficulty. An alignment below the sealing bar 25 would thus not be possible. A rotation-direction-conforming positioning of new rolls 5 or, as the case may be, a mounting of new rolls 5 in the particular installation position EB1 or EB2 with the appropriate direction of rotation is thus indispensable in order to be able to ensure disruption-free operation of the apparatus 1 or, as the case may be, of the packaging machine 3.

As soon as the adhesive label 22 has been detected by way of the capture device 23, the pin 27 is rotatingly moved until the adhesive label 22 faces toward the oppositely located installation position EB1. Only after this alignment of the adhesive label 22 can a fixing rod 14, which is only illustrated in FIG. 5, grip the outer layer 15 of the new roll 5 and position it below the sealing bar 25.

Further embodiments are conceivable, in which the new rolls 5 have no reflective adhesive label 22 and in which the capture device 23 or, as the case may be, the cameras 19 detect an externally arranged layer 15 of new rolls 5 or, as the case may be, the free end sections of new rolls 5 without an additional optical marking of the new rolls 5.

FIG. 5 shows the installation positions EB1 and EB2 of FIGS. 3 and 4 with extracted outer layer 15 of the new roll 5 mounted in the second installation position EB2. It is clearly discernible here that the externally arranged layer 15 of the roll 5, which is positioned in the second installation position EB2, dips downward coming from above, while the outer layer or, as the case may be, the material web MB of the roll 5 mounted in the first installation position EB1, is guided coming from below. Both rolls 5 rotate on their particular, associated pin 27 with the same direction of rotation or, as the case may be, counterclockwise. Rotation-direction-conforming mounting of the new rolls 5 is necessary in order to be able to ensure disruption-free and functioning operation of the apparatus 1 or, as the case may be, of the packaging machine 3 (cf. FIGS. 1 and 2).

With reference to the FIGS. 3, 4, and 5, it should be additionally noted that the two installation positions EB1 and EB2 for the rolls 5 with flat material and/or film material wound thereonto or, as the case may be, at least one of the installation positions EB1 and/or EB2 with their rotatable retaining pin in form of the rotatable pins 27 for the rolls 5 of flat material and/or film material can be designed to be height-adjustable, for instance, in order to be able to carry out an adaptation to different roll diameters and/or a correction of the conveying paths with gradually depleting material supply of a roll 5, which is being unwound and which therefore gradually decreases in diameter. For this purpose, in particular the frames, at which the horizontally arranged pins 27 are rotatably held and mounted, can have suitable methods and devices for height adjustment of the rotatable pins 27.

Figure 6:
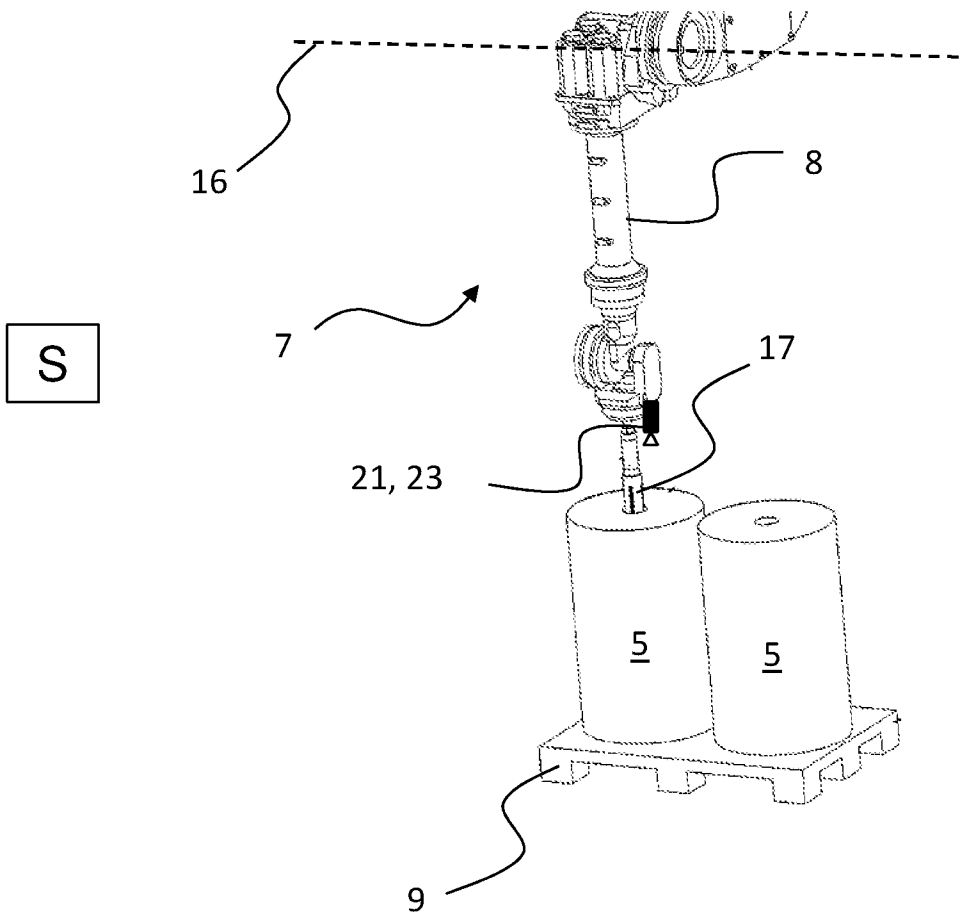
FIG. 6 shows a perspective view of a handling device as can be provided for conceivable embodiments of the apparatus according to the invention and for the implementation of the method according to the invention.
Figure 7:
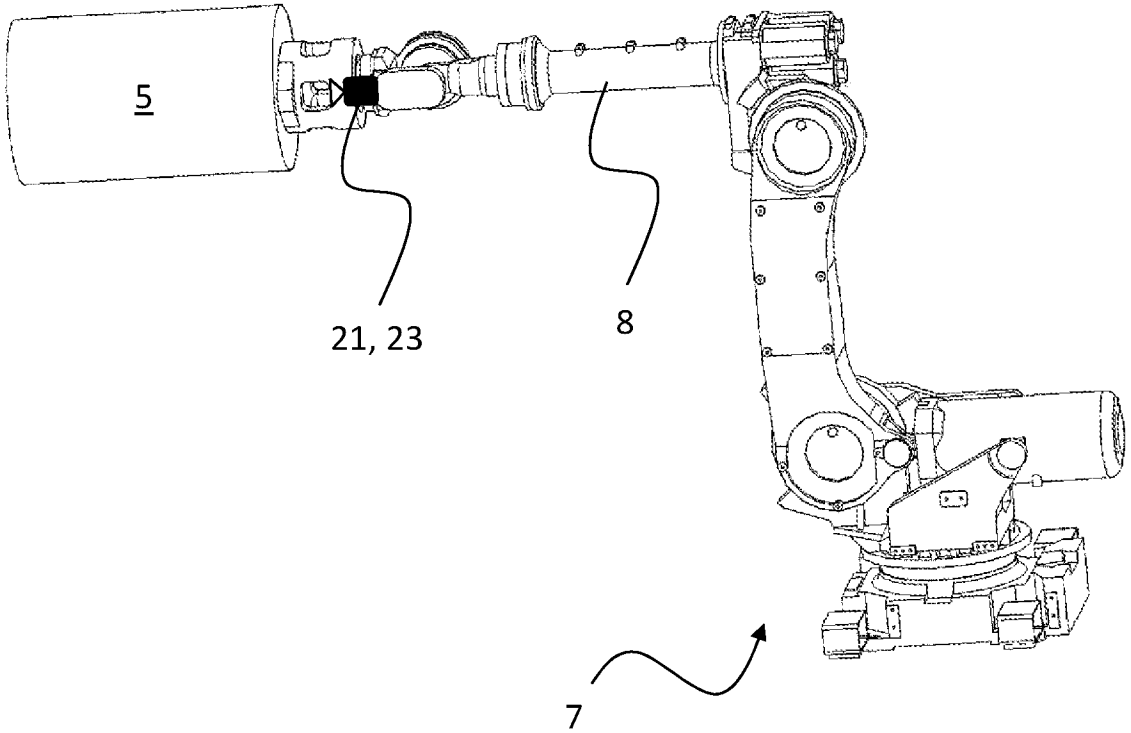
FIG. 7 shows the handling device from FIG. 6 after taking a new roll with rotation-direction-conforming orientation from a pallet.

The perspective view of FIG. 6 shows a handling device 7 as can be provided or, as the case may be, as can be used for conceivable embodiments of the apparatus 1 according to the invention and for the implementation of the method according to the invention.

The gripping arm 8 of the handling device 7 is pivotable about the horizontally oriented axis 16 such that the retaining mandrel 17 of the handling device 7 can be aligned with a vertical orientation of its longitudinal axis for the purpose of dipping into the core 6 of the particular new roll 5. If the particular new roll 5 has been seized by the handling device 7 or, as the case may be, by the retaining mandrel 17, the new roll 5 can be rotated about the axis 16 by another pivoting motion of the gripping arm 8 and can thereafter be mounted in its particular, associated installation position EB1 or EB2, as the case may be (cf. FIGS. 3 to 5).

FIG. 6 in particular shows a camera 21 or, as the case may be, a capture device 23. The capture device 23 or, as the case may be, the camera 21 is mechanically fixedly coupled with the gripping arm 8 such that it is guided together with the gripping arm 8 in a movement of the gripping arm 8. If the gripping arm 8 is pivoted about the axis 16, a direction of rotation or, as the case may be, rotation-direction-conforming orientation of one or more new rolls 5 can be determined by the camera 21 or, as the case may be, by the capture device 23. The capture device 23 or, as the case may be, the camera 21 is linked to the control unit S, which effects a new roll 5 that has an appropriate direction of rotation or, as the case may be, rotation-direction-conforming orientation, to be taken from the pallet 9 by the handling device 7.

The new rolls 5 of pallet 9 can have optical markers 22, as are exemplarily illustrated in FIG. 5, in order to facilitate the particular verification or, as the case may be, the determination of a particular direction of rotation or, as the case may be, rotation-direction-conforming orientation of the new rolls 5. It is also conceivable, however, that the new rolls 5 have no optical marker 22 and that the camera 21 or, as the case may be, the capture device 23 performs the particular verification or, as the case may be, determination of a particular direction of rotation or, as the case may be, rotation-direction-conforming orientation of the rolls 5 without an additional optical marker 22 of the new rolls 5. For this purpose, the camera 21 or, as the case may be, the capture device 23 can detect the position of the outer layer 15 of the new rolls and, in operative connection with the control unit S, can arrive at an assessment on the appropriate or wrong direction of rotation or, as the case may be, on the rotation-direction-conforming or the non-rotation-direction-conforming orientation of the particular new roll 5.

The perspective view of FIG. 7 shows the handling device 7 according to FIG. 6 while taking a new roll 5 with rotation-direction-conforming orientation from a pallet 9 (cf. FIG. 6). As is discernible in FIG. 7 and based on the position of the gripping arm 8 in FIG. 6, the gripping arm 8 was pivoted about the axis 16, which runs in the direction of the image plane in FIG. 7. The new roll 5 now has an at least approximately horizontal orientation and can be mounted in its particular, associated installation position EB1 or EB2, as the case may be.

Since the capture device 23 or, as the case may be, the camera 21 is mechanically fixedly coupled with the gripping arm 8, the capture device 23 or, as the case may be, the camera 21 was pivoted together with the gripping arm 8. In FIG. 7, the retaining mandrel 17 as illustrated in FIG. 6 has completely dipped into the core 6 of the new roll 5 and clampingly holds the new roll 5 to the gripping arm 8 or, as the case may be, to the handling device 7.

The invention has been described with reference to a preferred embodiment. Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

LIST OF REFERENCE CHARACTERS

1 Apparatus
3 Packaging machine
5 Roll
6 Core
7 Handling device
8 Gripping arm
9 Pallet
11 Retaining mandrel
12 Manipulator
13 Horizontal conveying device
14 Fixing rod
15 Externally arranged layer, outer layer
16 Axis of rotation, horizontal axis
17 Retaining mandrel
19 Camera
20 Container
21 Camera
22 Reflective adhesive label, optical marker
23 Capture device
25 Sealing bar
27 Pin
30 User, operator
EB1 Installation position
EB2 Installation position
MB Material web
S Control unit

The invention claimed is:

1. A method for handling flat material and/or film material that is wound onto rolls (5) and that serves as packaging material for the packaging of piece goods, bundles, or the like sets of articles comprising:

initially mounting a first roll (5) of flat material and/or film material on at least one of the at least two installation positions (EB1; EB2) of a packaging machine (3) and guiding a material web (MB) of the first roll into the packaging machine (3);

after at least partially depleting the first roll (5) of flat material and/or film materials, mounting a new roll (5) of flat material and/or film material on remaining installation position of the least two installation positions (EB1, EB2) of the packaging machine (3), wherein, after mounting the new roll (5), attaching an externally arranged layer (15) of the new roll (5) near or in the area of its free end to a section of a material web (MB) of the first roll (5) being guided in the packaging machine (3), determining an unwinding direction of rotation of the new roll (5) with a control unit (S) before, while, or after the new roll (5) is mounted, and, if an inappropriate unwinding direction of rotation is determined by the control unit (S), performing an alignment correction of the new roll (5) or replacing the new roll (5) with another new roll with an appropriate unwinding direction of rotation, wherein the control unit (S) in communication with a capture device (23) comprising an optical detection system.

2. The method of claim 1, further comprising autonomously removing the at least partially depleted rolls (5) by a handling device (7), which is in operative connection with the capture device (23), and further comprising autonomously mounting a new roll (5) of flat material and/or film material in one of the at least two installation positions (EB1, EB2).

3. The method of claim 2, wherein the capture device (23) determines the unwinding direction of rotation of each new roll (5) with at least one marker (22) in the area of a free end of each new roll (5).

4. The method of claim 3, further comprising applying the at least one marker (22) onto each new roll (5) before the new roll (5) is mounted and wherein the at least one marker fastens the free end of the new roll (5) to itself.

5. The method of claim 4, wherein the determining step comprises using a capture device (23) that is part of the handling device (7).

6. The method of claim 5, further comprising inserting a retaining mandrel (17) of the handling device (7) into a hollow body of the new roll (5) and increasing a maximum cross-sectional diameter of the retaining mandrel (17) and thereby clampingly fixing the new roll (5) to the handling device (7).

7. The method of claim 2, wherein the marker comprises an optical marker.

8. The method of claim 7, wherein the optical marker comprises a reflective marker.

9. The method of claim 2 wherein the inappropriate unwinding direction of rotation for the new roll (5) is the opposite of the unwinding direction of rotation for the first roll and wherein the appropriate unwinding direction of rotation for the new roll (5) is the same as the unwinding direction of rotation for the first roll.

10. The method of claim 1, wherein the mounting step comprises mounting each new roll (5) on one of the least one installation positions (EB1, EB2) so that its free end faces the other installation position (EB1, EB2).

11. The method of claim 10, further comprising moving new rolls (5) by way of at least one horizontal conveying device (13) and removing the new rolls (5) from the at least one horizontal conveying device (13) with the handling device (7).

12. An apparatus (1) for handling flat material or film material that is wound onto rolls (5) and that serves as packaging material for the packaging of piece goods, bundles, or sets of articles, comprising:

a packaging machine (3) with at least two installation positions (EB1, EB2), wherein each installation position (EB1, EB2) provides for the rotating reception of rolls (5) of flat material or film material, one or more a coupling devices, which align and attach free end sections of flat material or film material of newly mounted rolls (5) to a moving material web (MB) of a roll (5) that is already being guided into the packaging machine (3), at least one capture device (23) comprising an optical detection system, a control unit (S) in communication with the capture device (23), wherein the control unit (S) is capable of outputting information on the unwinding direction of rotation of new rolls (5) for each of the at least two installation positions (EB1, EB2).

13. The apparatus of claim 12, wherein the control unit (S) is in communication with a handling device (7) and is capable of instructing the handling device (7) to autonomously replace a roll (5), when it is depleted or nearly depleted, with a new roll (5) at the installation position previously occupied by the replaced roll (5), wherein the new roll (5) has an appropriate unwinding direction of rotation.

14. The apparatus of claim 13, wherein the handling device (7) comprises a cylindrically formed retaining mandrel (17) with an adjustable maximum cross-sectional diameter.

15. The apparatus of claim 14, wherein of each of the at least two installation positions (EB1; EB2) comprises a rotatable pin (27) for the reception of the rolls (5) that is height adjustable within the packaging machine (3).

16. The apparatus of claim 15, further comprising at least one horizontal conveying device (13) arranged upstream from the handling device (7).

17. The apparatus of claim 16, wherein the capture device (23) is a component of the handling device (7) and is movable with the handling device (7).

18. The apparatus of claim 17, capture device (23) comprises at least one camera (19, 21).

19. The apparatus of claim 16, wherein the capture device (23) is stationarily located in the area of the at least one installation position (EB1, EB2).

20. The apparatus of claim 19, capture device (23) comprises at least one camera (19, 21).

21. The apparatus of claim 13 wherein the appropriate unwinding direction of rotation for the new roll (5) is same unwinding direction of rotation as the roll at the other at least one installation position (ESL EΩ).

* * * * *